US008251476B2

(12) United States Patent
Shin et al.

(10) Patent No.: US 8,251,476 B2
(45) Date of Patent: Aug. 28, 2012

(54) INK DROP POSITION CORRECTION IN THE PROCESS DIRECTION BASED ON INK DROP POSITION HISTORY

(75) Inventors: Helen HaeKyung Shin, Fairport, NY (US); Howard A. Mizes, Pittsford, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 12/699,582

(22) Filed: Feb. 3, 2010

(65) Prior Publication Data

US 2011/0187777 A1 Aug. 4, 2011

(51) Int. Cl.
*B41J 29/38* (2006.01)

(52) U.S. Cl. ..... 347/14

(58) Field of Classification Search ..... 347/14, 347/19

See application file for complete search history.

(56) References Cited

U.S. PATENT DOCUMENTS

| | | | |
|---|---|---|---|
| 4,328,504 | A | 5/1982 | Weber et al. |
| 4,509,057 | A | 4/1985 | Sohl et al. |
| 5,075,689 | A | 12/1991 | Hoisington et al. |
| 5,160,938 | A | 11/1992 | Fargo et al. |
| 5,212,497 | A | 5/1993 | Stanley et al. |
| 5,477,244 | A | 12/1995 | Shibata et al. |
| 5,576,744 | A | 11/1996 | Niikura et al. |
| 5,726,690 | A | 3/1998 | Bohorquez et al. |
| 5,831,658 | A | 11/1998 | Iga et al. |
| 5,835,108 | A | 11/1998 | Beauchamp et al. |
| 5,847,724 | A | 12/1998 | Mantell |
| 5,903,681 | A | 5/1999 | Rueby et al. |
| 5,923,344 | A | 7/1999 | Norum et al. |
| 5,992,962 | A | 11/1999 | Yen et al. |
| 6,102,513 | A | 8/2000 | Wen |
| 6,141,114 | A | 10/2000 | Mantell et al. |
| 6,145,959 | A | 11/2000 | Lund et al. |
| 6,168,261 | B1 | 1/2001 | Miyake et al. |
| 6,206,502 | B1 | 3/2001 | Kato et al. |
| 6,247,787 | B1 | 6/2001 | Giere et al. |
| 6,273,542 | B1 | 8/2001 | Couwenhoven et al. |
| 6,315,383 | B1 | 11/2001 | Sarmast et al. |
| 6,367,903 | B1 | 4/2002 | Gast et al. |
| 6,390,580 | B1 | 5/2002 | Anderson et al. |
| 6,464,334 | B2 | 10/2002 | Lopez et al. |
| 6,532,026 | B2 | 3/2003 | Takahashi et al. |
| 6,568,786 | B2 | 5/2003 | Sarmast et al. |
| 6,590,598 | B2 | 7/2003 | Kodama |
| 6,764,156 | B2 | 7/2004 | Mantell |
| 6,814,425 | B2 | 11/2004 | Mott et al. |
| 6,819,352 | B2 | 11/2004 | Mizes et al. |
| 7,090,324 | B2 | 8/2006 | Mizes |
| 7,314,261 | B2 | 1/2008 | Jackson Pulver et al. |
| 7,347,525 | B2 | 3/2008 | Mizes |
| 7,367,642 | B2 | 5/2008 | Ouchi et al. |

(Continued)

*Primary Examiner* — Laura Martin

(74) *Attorney, Agent, or Firm* — Maginot, Moore & Beck, LLP

(57) ABSTRACT

A method compensates for changes in drop velocity of drops emitted by inkjets in a printhead of an ink jet imaging device. The method includes adjusting image data used to generate firing signals for an inkjet ejector in a printhead of an inkjet imaging device with an initial ink drop correction parameter, adjusting a portion of the adjusted image data with another ink drop correction parameter in response to the portion of the adjusted image data corresponding to a predetermined firing pattern mask, generating firing signals for the inkjet ejector from the adjusted image data, and transmitting the generated firing signals to the inkjet ejector in the printhead.

20 Claims, 9 Drawing Sheets

U.S. PATENT DOCUMENTS

| | | | | |
|---|---|---|---|---|
| 7,515,305 | B2 | 4/2009 | Mizes | |
| 7,524,007 | B2 | 4/2009 | Pulver et al. | |
| 7,524,015 | B2 | 4/2009 | Srinivasan et al. | |
| 7,543,911 | B2 | 6/2009 | Mizes et al. | |
| 7,597,418 | B2 | 10/2009 | Mantell et al. | |
| 2002/0135627 | A1* | 9/2002 | Takahashi et al. | 347/19 |
| 2003/0016263 | A1* | 1/2003 | Takahashi et al. | 347/19 |
| 2005/0248606 | A1* | 11/2005 | Hoshiyama et al. | 347/19 |
| 2009/0003729 | A1 | 1/2009 | Metcalfe et al. | |

* cited by examiner

INK DROP POSITION CORRECTION IN THE PROCESS DIRECTION BASED ON INK DROP POSITION HISTORY

TECHNICAL FIELD

This disclosure relates generally to ink drop position correction for an imaging device having one or more printheads, and, more particularly, to ink drop position correction based on ink drop position history.

BACKGROUND

Ink jet printers have print heads that operate a plurality of ejection jets from which liquid ink is expelled. The ink may be stored in reservoirs located within cartridges installed in the printer, or the ink may be provided in a solid form and then melted to generate liquid ink for printing. In these solid ink printers, the solid ink may be in either pellets, ink sticks, granules or any other shape. The solid ink pellets or ink sticks are typically placed in an "ink loader" that is adjacent to a feed chute or channel. A feed mechanism moves the solid ink sticks from the ink loader into the feed channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium.

A typical inkjet printer uses one or more printheads. Each printhead typically contains an array of individual nozzles for ejecting drops of ink across an open gap to an image receiving member to form an image. The image receiving member may be a continuous web of recording media or it may be a rotating intermediate imaging member, such as a print drum or belt. In the print head, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a print head controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

Ejections of ink drops from different inkjet ejectors in the same printhead are not always uniform. Slight variations in the drop ejection angles of the inkjet ejectors and different lengths of flight time for ink drops result in ink drops not landing at their intended locations. The different lengths of flight times for inkjet ejectors may arise from changing velocities for the ink drops as they are expelled from inkjet ejectors. For example, some inkjet ejector may eject an ink drop after some period of inactivity with a different velocity than an ink drop expelled after a series of ejections. Ink drops fired at different velocities from one or more rows of inkjet ejectors across the face of the printhead are likely to land at different positions in the process direction. This phenomenon may be visually detected as a ragged edge in an image. "Process direction" refers to the direction in which the image receiving member is moving as it passes the printhead and "cross-process direction" refers to the direction across the width of the image receiving member. Efforts to reduce ragged edges in images that arise from differences in ink drop velocities are worthwhile.

SUMMARY

A method enables the adjustment of image data to compensate for changes in velocities of ink drops emitted by inkjet ejectors in a printhead of an inkjet imaging device. The method includes adjusting image data used to generate firing signals for an inkjet ejector in a printhead of an inkjet imaging device with an initial ink drop correction parameter, adjusting a portion of the adjusted image data with another ink drop correction parameter in response to the portion of the adjusted image data corresponding to a predetermined firing pattern mask, generating firing signals for the inkjet ejector from the adjusted image data, and transmitting the generated firing signals to the inkjet ejector in the printhead.

In another embodiment, an inkjet imaging system compensates for changes in velocities of ink drops expelled by inkjet ejectors in a printhead of an inkjet imaging device. The system includes a printhead having inkjet ejectors configured to eject ink onto an image receiving member in response to firing signals, a memory in which a first ink drop correction parameter and a last ink drop correction parameter are stored for each inkjet ejector in the printhead, and a controller electrically coupled to the printhead and to the memory, the controller being configured to adjust image data used to generate firing signals for an inkjet ejector in a printhead of an inkjet imaging device with an initial ink drop correction parameter, to adjust a portion of the adjusted image data with another ink drop correction parameter in response to the portion of the adjusted image data corresponding to a predetermined firing pattern mask, to generate firing signals for the inkjet ejector from the adjusted image data, and to transmit the generated firing signals to the inkjet ejector in the printhead.

BRIEF DESCRIPTION OF THE DRAWINGS

The foregoing aspects and other features of a printer performing image data adjustments to compensate for different ink drop velocities from inkjet ejectors are explained in the following description, taken in connection with the accompanying drawings, wherein.

DETAILED DESCRIPTION

Figure 1:
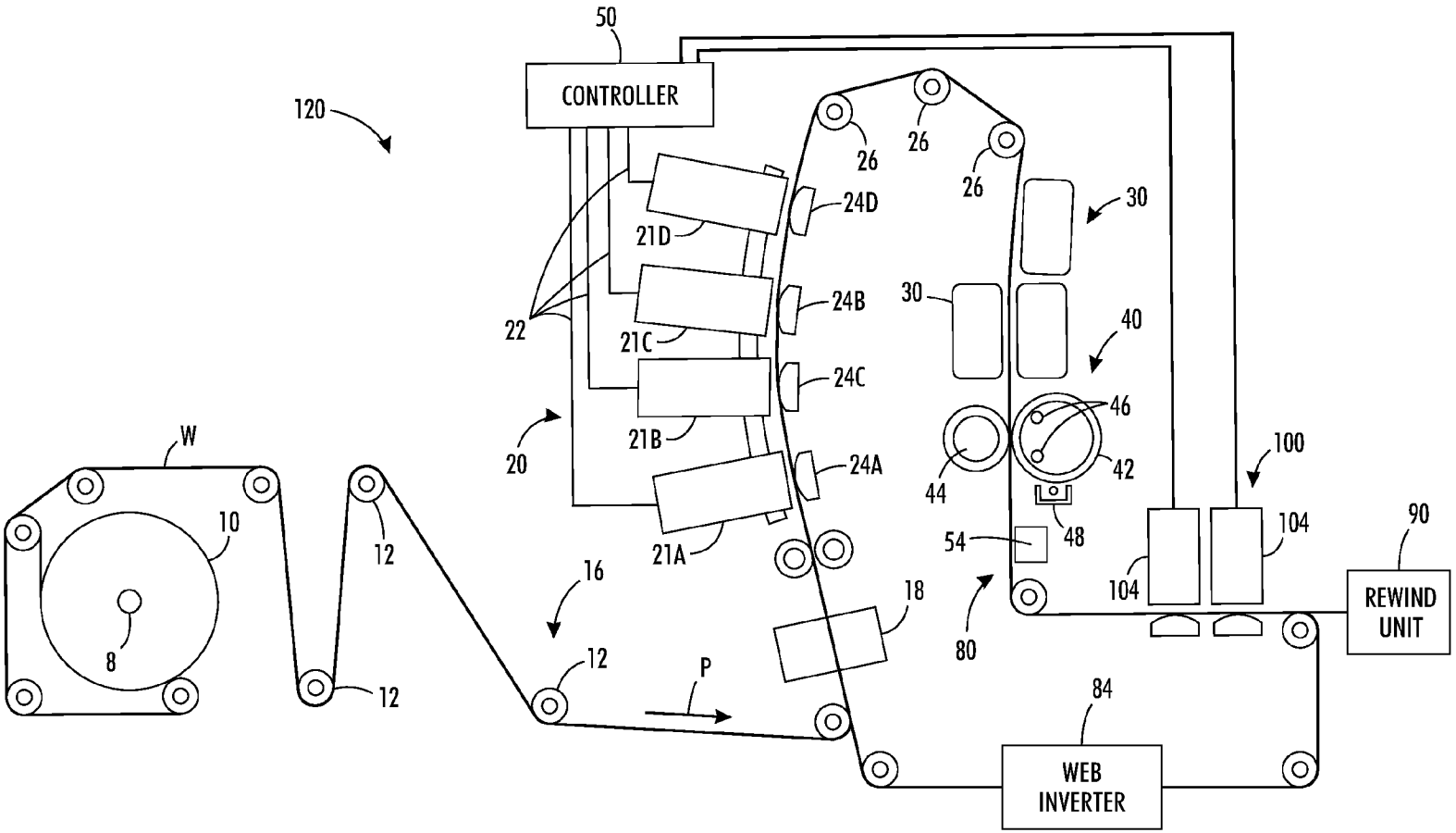
FIG. 1 is a schematic view of an inkjet imaging system that ejects ink onto a continuous web of media as the media moves past the printheads in the system.

Referring to FIG. 1, an inkjet imaging system 120 is shown. For the purposes of this disclosure, the imaging apparatus is in the form of an inkjet printer that employs one or more inkjet printheads and an associated solid ink supply. However, the present invention is applicable to any of a variety of other imaging apparatus that use inkjets to eject one or more colorants to a medium or media. The imaging apparatus includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

FIG. 1 is a simplified schematic view of a direct-to-sheet, continuous-media, phase-change inkjet imaging system 120. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 100, and rewind unit 90. For duplex operations, the web inverter 84 is used to flip the web over to present a second side of the media to the printing station 20, printed web conditioner 80, and coating station 100 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 100 before being flipped by the inverter 84 and laterally displaced by a distance that enables the web to travel over the other half of the rollers opposite the printing station 20, printed web conditioner 80, and coating station 100 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of print head modules 21A, 21B, 21C, and 21D, each printhead module effectively extending across the width of the media and being able to place ink directly (i.e., without use of an intermediate or offset member) onto the moving media. As is generally familiar, each of the print heads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four print heads to compute the position of the web as moves past the print heads. The controller 50 uses these data to generate timing signals for actuating the inkjet ejectors in the print heads to enable the four colors to be ejected with a reliable degree of accuracy for registration of the differently color patterns to form four primary-color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a print head module for each primary color may include one or more print heads; multiple print heads in a module may be formed into a single row or multiple row array; print heads of a multiple row array may be staggered; a print head may print more than one color; or the print heads or portions thereof can be mounted movably in a direction transverse to the process direction P, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the print head. As used herein, liquid ink refers to melted solid ink, heated gel ink, or other known forms of ink, such as aqueous inks, ink emulsions, ink suspensions, ink solutions, or the like.

Associated with each print head module is a backing member 24A-24D, typically in the form of a bar or roll, which is arranged substantially opposite the print head on the back side of the media. Each backing member is used to position the media at a predetermined distance from the print head opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the print heads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the print heads of the printing station 20, the temperature of the media is maintained within a given range. Ink is ejected from the print heads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the print heads of the printing station 20. Temperature sensors (not shown) may be positioned along this portion of the media path to enable regulation of the media temperature. These temperature data may also be used by systems for measuring or inferring (from the image data, for example) how much ink of a given primary color from a print head is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 1, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 100 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 100 may apply the clear ink with either a roller or a print head ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the print heads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 120 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the difference minimization function, described above. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The imaging system 120 may also include an optical sensor 54. The drum sensor is configured to detect, for example, the presence, intensity, and/or location of ink drops jetted onto the receiving member by the inkjets of the print head assembly. In one embodiment, the optical sensor includes a light source and a light detector. The light source may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

A reflectance may be detected by the light detector in optical sensor 54 that corresponds to each ink jet and/or to each pixel location on the receiving member. The light sensor is configured to generate electrical signals that correspond to the reflected light and these signals are provided to the controller 50. The electrical signals may be used by the controller 50 to determine information pertaining to the ink drops ejected onto the receiving member as described in more detail below. Using this information, the controller 50 may make adjustments to the image data to alter the generation of firing signals to either retard or quicken the ejection of an ink drop or drops from an inkjet ejector.

In order to adjust image data in accordance with a drop history for an inkjet ejector, a drop history for each inkjet ejector is obtained. One method of obtaining an appropriate drop history is now described although other methods may be used to obtain a first ink drop correction parameter and a last ink drop correction parameter. As used herein "first ink drop" refers to an ink drop ejected by an inkjet ejector after some period of inactivity for the inkjet ejector. The inactive period may only be for a few firing cycles, but sufficiently long enough to cause the inkjet ejector to expel the ink drop at a velocity different than ink drops ejected on the next firing cycle after one in which an ink drop has been ejected. "Last ink drop" refers to the last ink drop ejected by an inkjet ejector and the position of the ink drop relative to other ink drops ejected from an inkjet ejector after a series of at least two consecutive ink drop ejections.

Figure 2A:
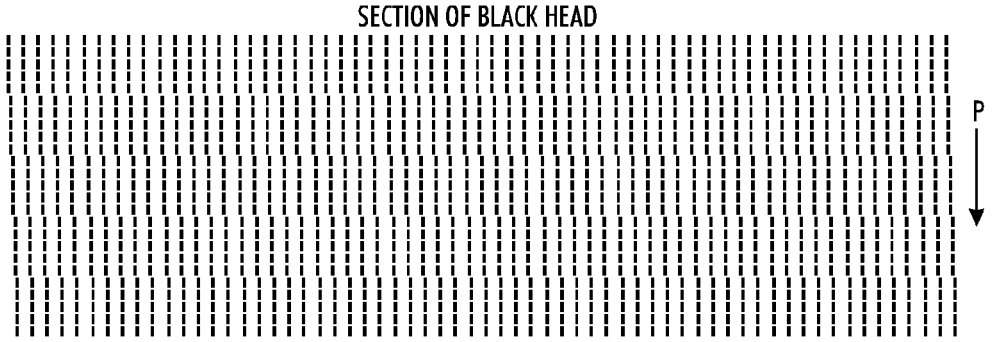
FIG. 2A is a depiction of a test pattern that may be used to determine an ink drop history for inkjet ejector in the printheads of the system shown in FIG. 1
Figure 2B:
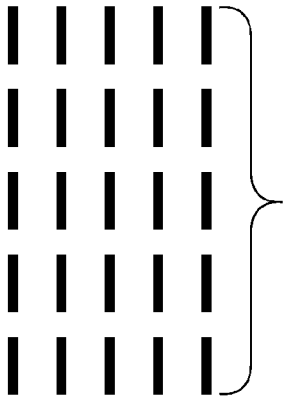
FIG. 2B is an enlarged view of a portion of the test pattern in FIG. 2A.

One test pattern that may be used to obtain a drop history for each inkjet ejector in a printhead is shown in FIG. 2A. The pattern is formed by generating the firing signals for each fifth inkjet ejector in a row across the face of a printhead. As shown in the exploded view of FIG. 2B, the space between process direction lines are the area in which adjacent inkjet ejectors would eject ink drops if activated. Thus, each fifth inkjet ejector in the row of inkjet ejectors ejects a series of thirty-five, for example, ink drops to form a single process direction line that extends in the process direction P. In one embodiment, each inkjet ejector is operated to generate five process direction lines, as shown in FIG. 2B, to improve the accuracy of the processed data obtained from the image of the test pattern. Following the generation of a group of process direction lines by the first line of inkjet ejectors, the second inkjet ejector and each fifth inkjet ejector in the row from it in the cross-process direction are operated in a similar manner to form another group of process direction lines. This operation of the inkjet ejectors continues until all of the inkjet ejectors in a printhead have been operated by a controller generating firing signals to form a plurality of groups of process direction lines on the image receiving member that ensure each inkjet ejector has printed a set of process direction lines in one of the groups of process direction lines. This process may be repeated for different patterns to obtain position information for different inkjet ejector drop histories.

The inkjet ejectors are operated as described above to produce the staggered test pattern so information about the location of the first and last drops may be obtained without interference from ink drops ejected by neighboring inkjet ejectors. Additionally, the length of a process direction line is chosen with reference to a combination of the printing speed and the imaging rate of the optical sensor. In the depicted example, the process direction lines is produced with a sequence of thirty-five consecutive ink drop ejections, the test pattern is printed at 537.5 spi (spots per inch) in the process direction and is imaged at 269 spi in the process direction.

As noted above, an optical sensor may be operated to generate image data corresponding to the ink drop positions on the image receiving member. The optical sensor includes a light source and a light detector. The light source is directed towards the image receiving member and the light detector is located at a position to receive the reflected light. In the locations where the image receiving member is not covered by ink, most of the light is reflected by the image receiving member into a sensor in the light detector. In response, the sensor generates an electrical signal having a magnitude corresponding to the intensity of the reflected light. Thus, the signals generated by sensors in the light detector that receive light reflected by ink drops are lower than the signals generated by sensors that receive light reflected by the bare image receiving member. These electrical signals comprise image data of the test pattern. These image data are provided to a controller configured to process the image data and generate the first ink drop correction parameter and the last ink drop correction parameter for each inkjet in the printhead. The optical sensor may be positioned in the imaging system, as shown in FIG. 1, or it may be within an offline scanner through which the printed media is scanned after the media is removed from the imaging system.

Figure 3:
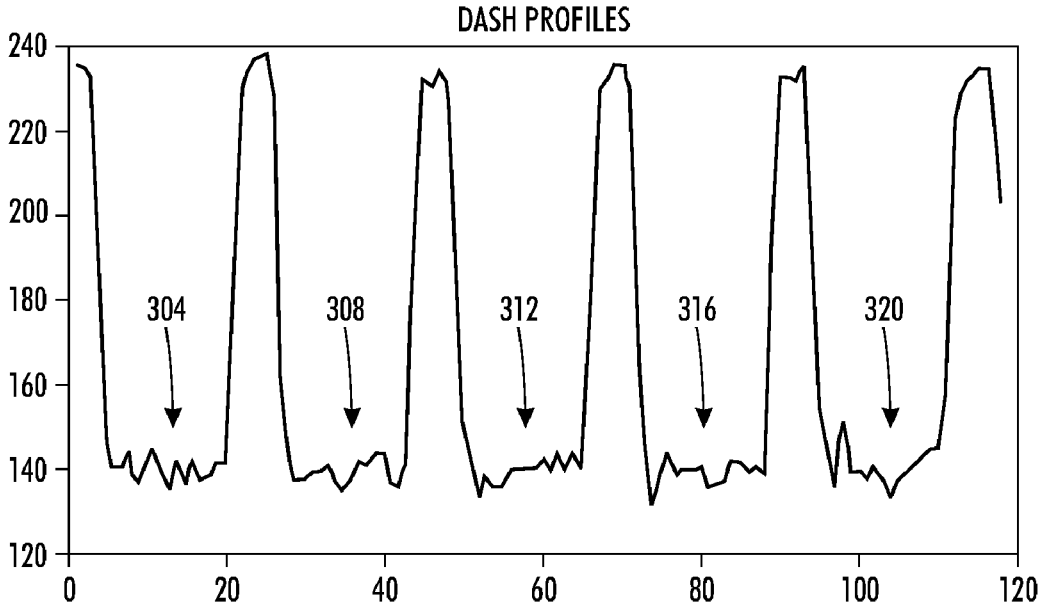
FIG. 3 is a density profile of a set of process control lines in the test pattern of FIGS. 2A and 2B.
Figure 4:
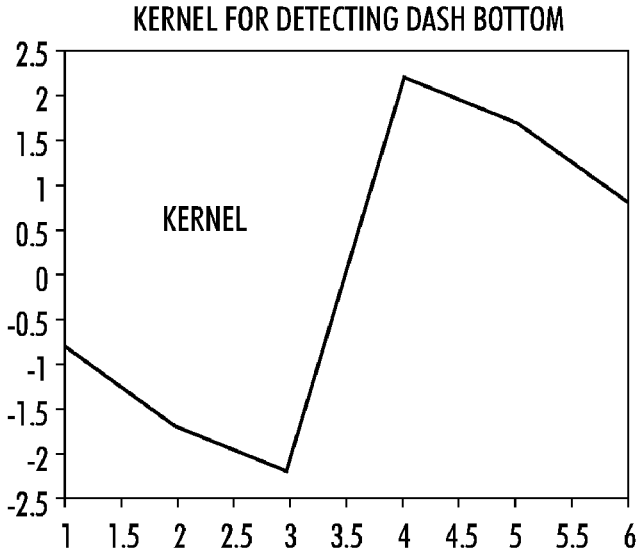
FIG. 4 is a last drop kernel function used to detect the last ink drop position from the density profile of FIG. 3.
Figure 5:
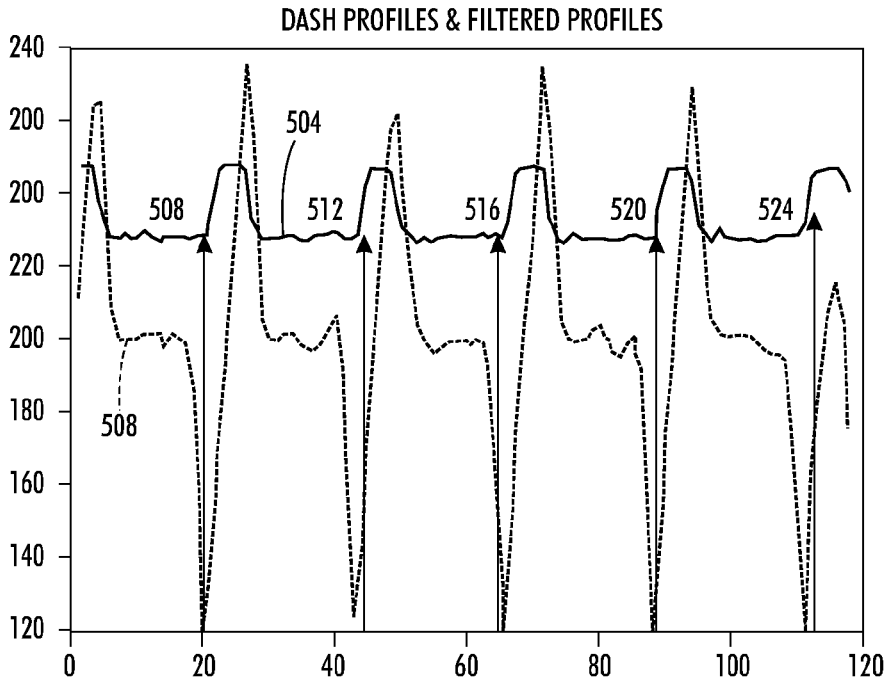
FIG. 5 is a graph of a last drop kernel function and the convolved density profile of FIG. 3.

The image data of the test pattern in FIG. 2A provide a density profile such as the one shown in FIG. 3. The areas of low response 304, 308, 312, 316, and 320 correspond to the process direction lines for one of the inkjet ejectors shown in FIG. 2B. In order to identify a first ink drop position and a last ink drop position, the areas of low response are convolved with a first kernel function and a last kernel function by the controller configured to process the image data. In one embodiment, the last kernel function used is the one shown in FIG. 4. The last kernel function is defined so the convolution of the density profile and the last kernel function is a minimum at the bottom of a process direction line. FIG. 5 depicts a convolution 504 of the last kernel signal 508 and the profile for the five process direction lines to identify the minimums for the last ink drops at arrows 508, 512, 516, 520, and 524. The corresponding first kernel function would be the opposite sign of the last kernel function and the convolved signal is a minimum at the top of the process direction line. Thus, the controller convolves each density profile for the process direction lines for an inkjet ejector with the first kernel function and the second kernel function to identify the image data for the first ink drop and the last ink drop in each process direction line. Standard signal processing techniques, such as quadratic interpolation, may be used to estimate first and last drop positions at resolutions greater than the imaging resolution of the optical sensor in the process direction. The five last ink drop positions for an inkjet ejector may be averaged to improve the accuracy of the last ink drop position and the five first ink drop positions may be similarly averaged.

To generate a last ink drop correction parameter for each inkjet ejector, the controller configured to process the image data for the test pattern computes a mean average for the last ink drop position for each inkjet ejector that formed a process line or lines. For example, if only one process line is produced for each inkjet ejector, then the last ink drop positions for all of the process direction lines in one group of process lines are averaged to compute an average last ink drop position. If a set of process direction lines are formed by each inkjet ejector, as described in the example above, the average last ink drop positions for all of the inkjet ejectors that formed the group of process direction lines are averaged to compute an average last ink drop position. A last ink drop position parameter is then computed by taking the difference between the actual last ink drop position (for a single process direction line) or the average last ink drop position (for a set of process direction lines printed by a single inkjet ejector) and the average last ink drop position for the inkjet ejectors that generated one group of process direction lines in the test pattern. A last ink drop correction parameter is then calculated by taking the negative of the last ink drop position parameter and rounding to an integral pixel unit.

To generate a first ink drop correction parameter for each inkjet ejector, the controller configured to process the image data for the test pattern computes a mean average for the first ink drop position for each inkjet ejector that formed a process line or lines. For example, if only one process line is produced for each inkjet ejector, then the first ink drop positions for all of the process direction lines in one group of process lines are averaged to compute an average first ink drop position. If a set of process direction lines are formed by each inkjet ejector, as described in the example above, the average first ink drop positions for all of the inkjet ejectors that each formed a set of process direction lines are averaged to compute an average first ink drop position. A first ink drop position parameter is then computed by taking the difference between the actual first ink drop position (for a single process direction line) or the average first ink drop position (for a set of process direction lines printed by a single inkjet ejector) and the average first ink drop position for the inkjet ejectors that generated one group of process direction lines in the test pattern. A first ink drop correction parameter is calculated by taking the difference between the first ink drop position parameter and the last ink drop position parameter.

Figure 6:
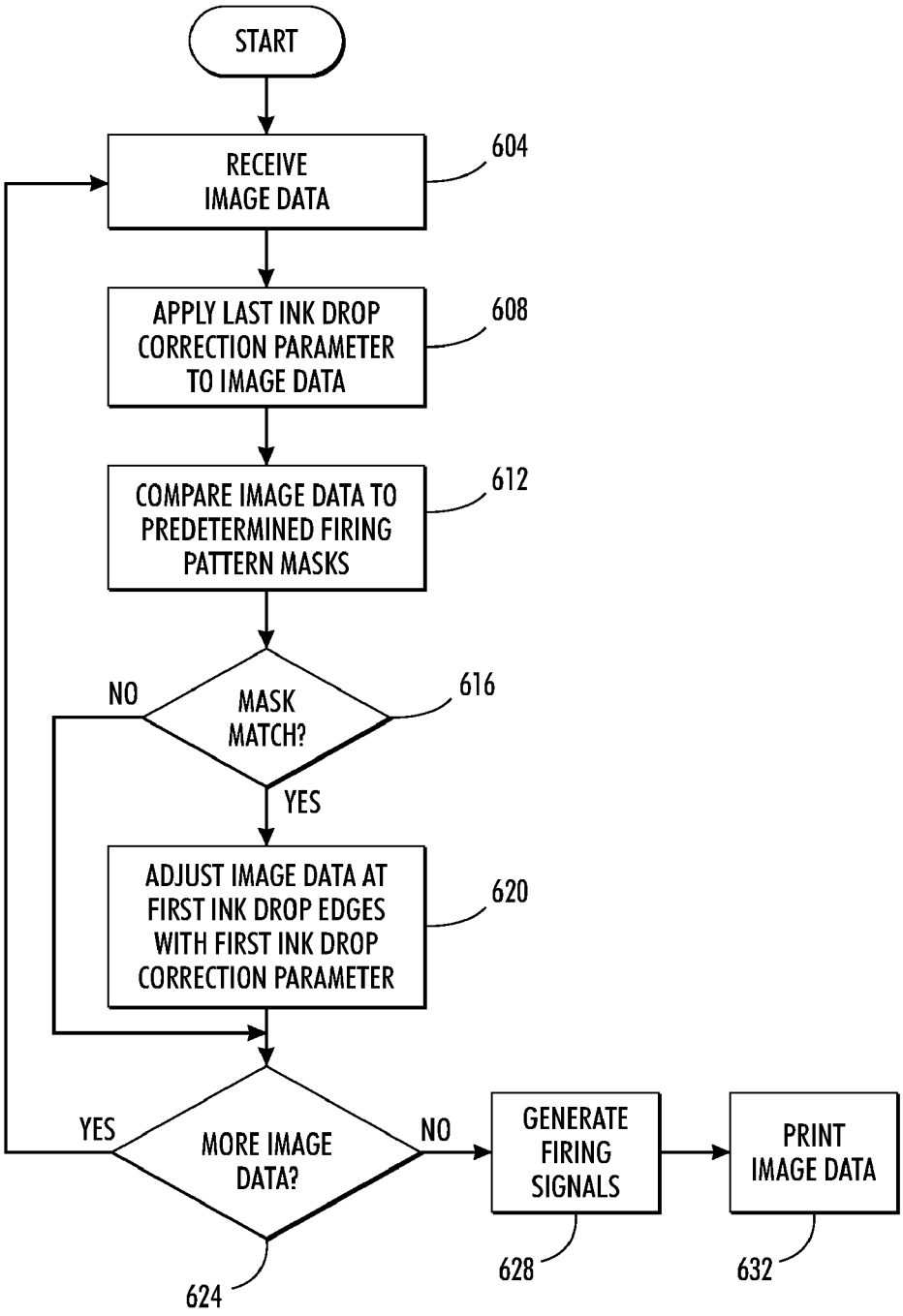
FIG. 6 is a flow diagram of a process for adjusting image data to compensate for ink drop positions using the last drop correction parameters, first ink drop positions, and the relative differences between the last ink drop positions and the first ink drop positions as determined with reference to the test pattern of FIG. 2A.
Figure 7A:
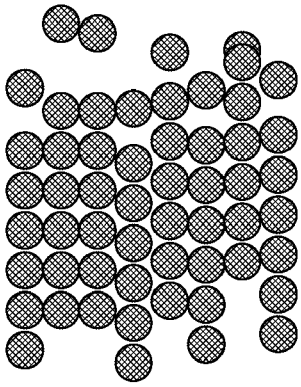
FIGS. 7A, 7B, and 7C depict corrections made to a printed pattern (FIG. 7A) arising from the last ink drop relative difference corrections (FIG. 7B) and first ink drop relative differences (FIG. 7C).
Figure 7B:
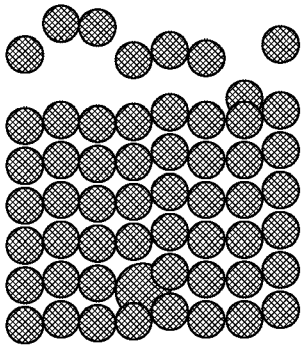

Once the first ink drop correction parameter and the last ink drop correction parameter have been generated and stored in a memory for each inkjet ejector in a printhead, the controller may configured with appropriate programming and circuitry to perform the image data adjustment process shown in FIG. 6. After the controller has received image data for printing a portion of an image (block 604), the controller applies the last ink drop correction parameter to the image data that are used to generate the firing signals for the inkjet ejectors. For example, consider the ink drop pattern that would be generated by an image data block of seven by eight image data pixels. Although a solid rectangular block is intended, the block depicted in FIG. 7A would actually be printed. By applying the last ink drop correction parameter to each column of the image data to be used to generate the firing signal for each of the eight inkjet ejectors that eject the ink drops to print the block, the image data is adjusted to correspond to a printed block that looks like FIG. 7B. That is, by shifting the image data in a column for a particular inkjet ejector by the relative difference between the average last ink drop position for the inkjet ejectors that formed a group of process direction lines in the test pattern and the last ink drop position for the inkjet ejector, the inkjet ejector responds by ejecting the ink drops closer to the intended position. This adjustment, however, fails to adjust the first drops ejected in each column.

The remainder of the process in FIG. 6 adjusts the image data corresponding to the first ink drops to adjust the first ink drop edge. The process makes this adjustment by comparing a sequence of image data that are used to generate firing signals for the inkjet ejector to one or more predetermined firing pattern masks (block 612). The firing pattern masks are designed to detect first drop firing patterns. The process determines whether the mask matches the image data (block 616). If no match is presented, then the image data are not adjusted and the process continues by checking whether more image data is available for processing (block 624). If a match is present, the image data are adjusted with reference to the first ink drop correction parameter (block 620). The process then determines whether additional image data are to be processed (block 624) and if so, the process continues (block 612). Otherwise, the firing signals corresponding to the adjusted image data are generated (block 628) and the image is printed (block 632). The process described with reference to FIG. 6 preprocesses image data before printing the image data. This process may be adapted to be performed by parallel processors, one processor per inkjet ejector, to adjust image data used to generate firing signals for the corresponding inkjet ejector.

Figure 7C:
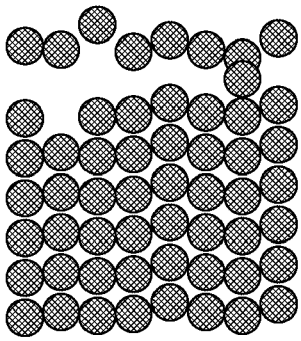
Figure 8A:
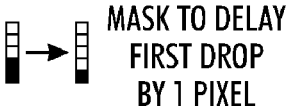
FIG. 8A and FIG. 8B depict image data masks that may be used to adjust image data as shown in the figures.
Figure 8B:
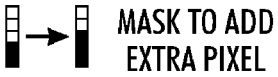

Again with reference to FIGS. 7A, 7B, and 7C, FIG. 7C depicts the further adjustment of the image data resulting in the first ink drops. Specifically, the first ink drop correction parameter is used to select an appropriate mask or masks. Such a mask is shown in FIG. 8A. The relative difference between the first ink drop for the inkjet ejector compared to the average position for the first ink drop correlates to distance that corresponds to the mask in FIG. 8A. The first image data in column two is selected because it is highest in the process direction and column 7 is also selected because it is the lowest. Applying the mask in FIG. 8A to the sequence in the original image data results in the first image data pixel being removed to enable the second image pixel to cause the inkjet ejector to eject an ink drop that will produce the first ink drop in the second column of FIG. 7C. Likewise, the mask of FIG. 8B that corresponds to the first ink drop correction parameter for the inkjet ejector that ejects the ink drops for the seventh column adds an extra pixel to the image data to make its first ink drop better align with the other first ink drops.

Figure 9:
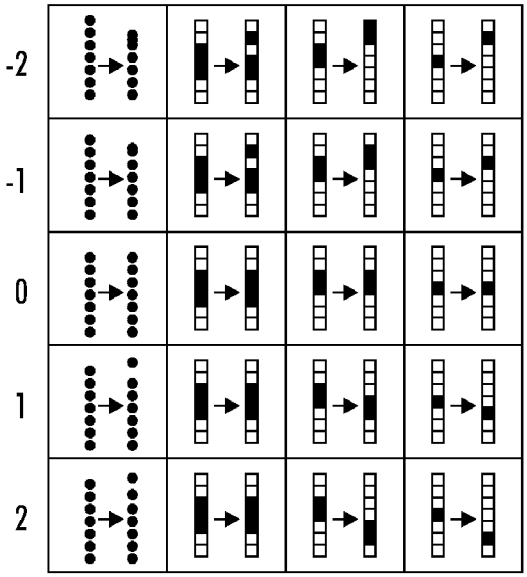
FIG. 9 is a table of possible image data masks that may be used to adjust image data for various first ink drop relative differences.

A more general form of the masks and their correlation to various first ink drop correction parameters is shown in FIG. 9. In that figure, the far left hand box shows an intended ink drop pattern and an actual ink drop pattern that corresponds to the relative difference shown at the left hand margin of the table. For the boxes to the right of the ink drop patterns, a pair of image data patterns is presented with an arrow between them. The pattern on the left in each of those boxes is an image data mask that, if present in an image, may cause artifacts that may be due to velocity errors in the first drop. The second image data pattern indicated by the arrow is the adjustment made to the image data to cause different firing signals to be generated that result in an actual ink drop pattern that is closer to the intended ink drop pattern. As the table indicates, greater adjustments are required for larger relative differences.

Figure 10A:
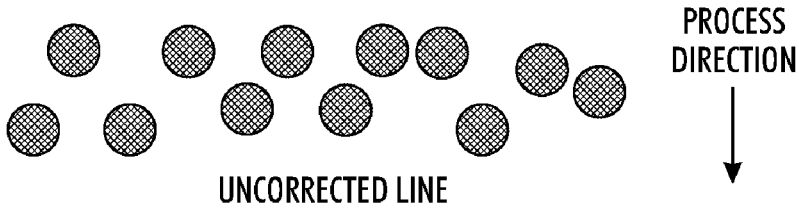
FIGS. 10A, 10B, and 10C depict corrections made to a printed pattern for a single pixel width line (FIG. 10A) arising from the last ink drop relative difference corrections (FIG. 10B) and first ink drop relative differences (FIG. 10C).
Figure 10B:
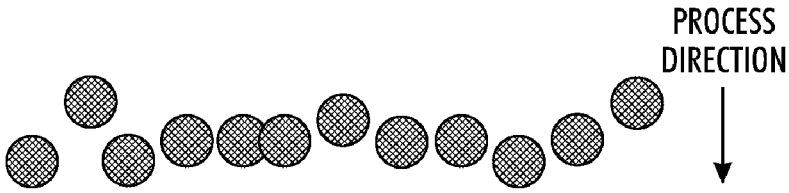
Figure 10C:
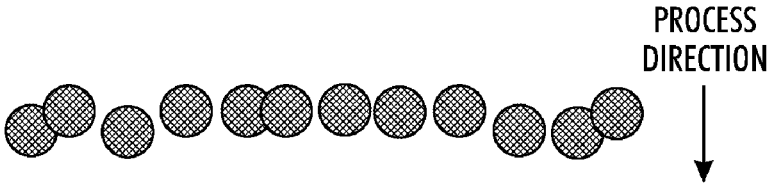

FIGS. 10A, 10B, and 10C illustrate a single pixel horizontal line that may be corrected by an imaging system implementing the system and method described herein. FIG. 10A is an actual line that would be printed by a set of adjacent inkjet ejectors from a single line of image data pixels. After the last ink drop correction parameters have been used to adjust the image data pixels, the pattern of FIG. 10B would be printed. As shown in that figure, two of the ink drops would still present a somewhat ragged appearance because they are printed slower than the drops from the other inkjet ejectors. By applying the first drop correction parameter, the image pixels for those two ink drops are moved to cause these first ink drops to be ejected as shown in FIG. 10C at a position corresponding to the relative difference in the first ink drop correction parameter.

Figure 11A:
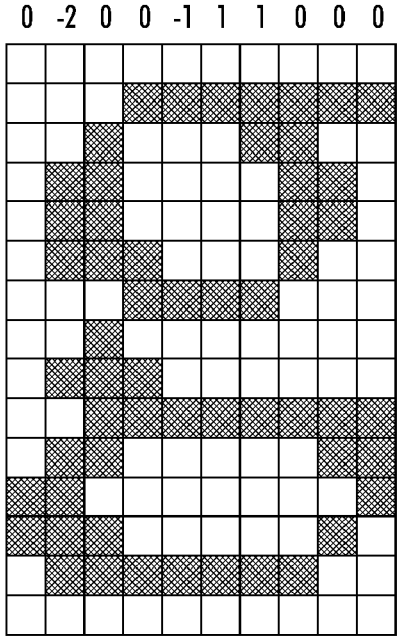
FIG. 11A depicts image data for a character and FIG. 11B depicts adjusted image data for the character to compensate for the last ink drop relative differences and the first ink drop relative differences in the inkjet ejectors used to print the character.
Figure 11B:
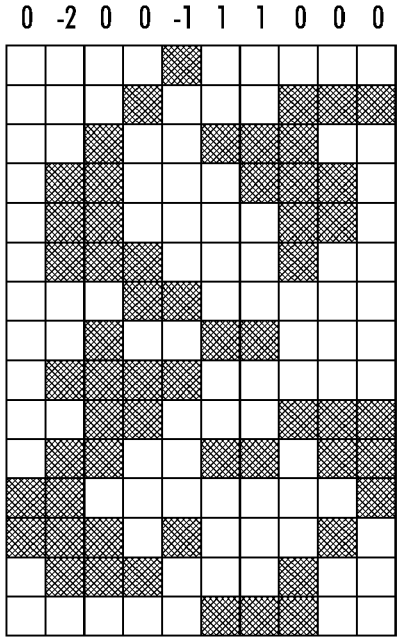

Applying the last ink drop correction parameters and the first ink drop correction parameters enable the variations in inkjet ejector performance to be compensated to some degree. For example, the image data corresponding to the letter "g" is shown in FIG. 11A. These image data are adjusted by applying the last ink drop correction parameter and the first ink drop correction parameter for the ten inkjet ejectors that print the character to the image data. A representation of the adjusted data is shown in FIG. 11B. These adjusted data result in the generation of firing signals that take into account the first and last ink drop characteristics as determined from the test pattern and produce a clearer character that one would expect looking at the representation in FIG. 11B.

While the description above describes a process for image data adjustments that compensate for inkjet ejection velocity differences by correcting for the position of last drops followed by a correction based on the difference between first and last drops, the processing may be reversed. That is, the process may first correct for the position of first drops followed by a correction based on the difference between last and first drops. Thus, the process may be described generally as applying an initial ink drop correction parameter to all of the image data to be printed by an inkjet ejector and selectively applying a second ink drop correction parameter in response to the image data corresponding to a predetermined firing pattern mask. Consequently, the system implementing the process transforms the image data into image data constructed to compensate for firing pattern behaviors detected in the analysis of the test pattern. Specifics of the artifacts generated by the drop position errors at the lead and trailing edges of patterns of drops may cause one process to be preferred over another. More often though, the velocity for ink drops in a series of ink drops reaches a steady state. Consequently, the first drop or the first few drops ejected exhibit the behavior that varies from ejector to ejector in most inkjet printing systems.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of adjusting inkjet imaging device operation comprising:

adjusting image data used to generate firing signals for an inkjet ejector in a printhead of an inkjet imaging device with an initial ink drop correction parameter;

adjusting a portion of the image data adjusted with the initial ink drop correction parameter with another ink drop correction parameter before the image data adjusted with the initial ink drop correction parameter are used to generate firing signals for the inkjet ejector in response to the portion of the image data adjusted with the initial ink drop correction parameter corresponding to a predetermined firing pattern mask;

generating firing signals for the inkjet ejector from the image data adjusted with the initial drop correction and with the other ink drop correction parameter; and transmitting the generated firing signals to the inkjet ejector in the printhead to operate the inkjet ejector to print the image data adjusted with the initial drop correction and with the other ink drop correction parameter.

2. The method of claim 1 wherein the initial ink drop correction parameter is a first ink drop correction parameter.

3. The method of claim 2 wherein the other ink drop correction parameter is a last ink drop correction parameter.

4. The method of claim 2 wherein the predetermined firing pattern mask is a sequence of binary image data values.

5. The method of claim 1 wherein the initial ink drop correction parameter is a last ink drop correction parameter.

6. The method of claim 5 wherein the other ink drop correction parameter is a first ink drop correction parameter.

7. The method of claim 5 further comprising:

storing in a memory a last ink drop correction parameter for the inkjet ejector in the printhead; and storing in a memory a first ink drop correction parameter for the inkjet ejector in the printhead.

8. The method of claim 5 further comprising:

generating the initial ink drop correction parameter for the inkjet ejector in the printhead with reference to a distance between a last ink drop position for a last ink drop ejected from the inkjet ejector in the printhead and an average last ink drop position for a plurality of last ink drops ejected from a plurality of inkjet ejectors in the printhead; and generating the other ink drop correction parameter for the inkjet ejector in the printhead with reference to a position for each first ink drop ejected from each inkjet ejector in the plurality of inkjet ejectors in the printhead and the initial ink drop correction parameter generated for the corresponding inkjet ejector in the printhead.

9. The method of claim 1 further comprising:

ejecting a sequence of ink drops from each inkjet ejector in a plurality of inkjet ejectors onto an image receiving member to form a pattern on the image receiving member; and generating an image of the pattern on the image receiving member.

10. The method of claim 9 further comprising:

generating a density profile of the pattern image to identify image data for a sequence of ink drops ejected by each inkjet ejector in the plurality of inkjet ejectors in the printhead;

convolving a first function with the identified image data for a sequence of ink drops ejected by one of the inkjet ejectors in the plurality of inkjet ejectors to identify image data corresponding to a last ink drop in the sequence of ink drops ejected by the one inkjet ejector; and convolving a second function with the identified image data for a sequence of ink drops ejected by the one inkjet ejector to identify image data corresponding to a first ink drop in the sequence of ink drops ejected by the one inkjet ejector.

11. The method of claim 10 further comprising:

identifying a last ink drop position for each last ink drop in each sequence of ink drops ejected by each inkjet ejector in the plurality of inkjet ejectors;

computing an average last ink drop position from the identified last ink drop positions for each inkjet ejector in the plurality of inkjet ejectors;

computing a distance between the identified last ink drop position for each inkjet ejector in the plurality of inkjet ejectors and the average last ink drop position;

storing in a memory for each inkjet ejector in the plurality of inkjet ejectors the computed distance between the identified last ink drop position for an inkjet ejector and the average last ink drop position with an opposite sign as a last ink drop correction parameter;

identifying a last ink drop position for each last ink drop in each sequence of ink drops for each inkjet ejector in the plurality of inkjet ejectors;

computing an average first ink drop position from the identified first ink drop positions for each inkjet ejector in the plurality of inkjet ejectors;

computing a distance between the identified first ink drop position for each inkjet ejector in the plurality of inkjet ejectors and the average first ink drop position;

computing a distance between the computed distance between the identified first ink drop position for an inkjet ejector and the average first ink drop position and the last ink drop correction parameter for the inkjet ejector; and storing in a memory for each inkjet ejector in the plurality of inkjet ejectors the computed distance between the identified first ink drop position for an inkjet ejector and the average first ink drop position and the last ink drop correction parameter as the first ink drop correction parameter.

12. An inkjet imaging system that compensates for changes in drop velocity in inkjet ejectors, the system comprising:

a printhead having inkjet ejectors configured to eject ink onto an image receiving member in response to firing signals;

a memory in which an initial ink drop correction parameter and another ink drop correction parameter are stored for each inkjet ejector in the printhead; and a controller electrically coupled to the printhead and to the memory, the controller being configured to adjust image data used to generate firing signals for each inkjet ejector in the printhead of the inkjet imaging device with reference to the initial ink drop correction parameter stored in the memory for the corresponding inkjet ejector, to adjust a portion of the image data adjusted with reference to the initial ink drop correction parameter for each inkjet ejector with the other ink drop correction parameter stored in the memory for the corresponding inkjet ejector in response to the portion of the image data adjusted with reference to the initial ink drop correction parameter for each inkjet ejector corresponding to a predetermined firing pattern mask before the image data adjusted with the other ink drop correction parameter is used to generate firing signals, to generate firing signals for each inkjet ejector from the image data adjusted for each inkjet ejector with reference to the initial ink drop correction parameter and with reference to the other ink drop correction parameter, and to transmit the firing signals generated for each inkjet ejector to the corresponding inkjet ejector in the printhead.

13. The system of claim 12 wherein the initial ink drop correction parameter stored in the memory for each inkjet ejector is a first ink drop correction parameter.

14. The system of claim 13 wherein the other ink drop correction parameter stored in the memory for each inkjet ejector is a last ink drop correction parameter.

15. The system of claim 12 wherein the initial ink drop correction parameter stored in the memory for each inkjet ejector is a last ink drop correction parameter.

16. The system of claim 15 wherein the other ink drop correction parameter stored in the memory for each inkjet ejector is a first ink drop correction parameter.

17. The system of claim 12 wherein the predetermined firing pattern mask is a sequence of binary image data values.

18. The system of claim 12, the controller being further configured to generate the initial ink drop correction parameter for each inkjet ejector in the printhead with reference to a distance between a last ink drop position for a last ink drop ejected from each inkjet ejector in the printhead and an average last ink drop position for a plurality of last ink drops ejected from the inkjet ejectors in the printhead, and to generate the other ink drop correction parameter for each inkjet in the printhead with reference to a first ink drop position for each first ink drop ejected from each inkjet ejector in the printhead and the initial ink drop correction parameter generated for the corresponding inkjet ejector in the printhead.

19. The system of claim 12, the controller being further configured to operate the inkjet ejectors in the printhead to eject a sequence of ink drops from each inkjet ejector in the printhead onto an image receiving member to form a pattern on the image receiving member; and the controller being electrically coupled to an optical sensor to receive an image of the pattern on the image receiving member.

20. The system of claim 19, the controller being further configured to generate a density profile of the pattern image to identify image data for a sequence of ink drops ejected by each inkjet ejector in the printhead, to convolve a first function with the identified image data for a sequence of ink drops for each inkjet ejector to identify image data corresponding to a last ink drop in the sequence of ink drops for each inkjet ejector, to convolve a second function with the identified image data for a sequence of ink drops for each inkjet ejector to identify image data corresponding to a first ink drop in the sequence of ink drops for each inkjet ejector, to identify a last ink drop position for each last ink drop in each sequence of ink drops for each inkjet ejector, to compute an average last ink drop position from the identified last ink drop positions for each inkjet ejector, to compute a distance between the identified last ink drop position for each inkjet ejector and the average last ink drop position, to store in the memory for each inkjet ejector the computed distance between the identified last ink drop position for each inkjet ejector and the average last ink drop position with an opposite sign as the initial ink drop correction parameter, to identify a last ink drop position for each last ink drop in each sequence of ink drops for each inkjet ejector, to compute an average first ink drop position from the identified first ink drop positions for each inkjet ejector, to compute a distance between the identified first ink drop position for each inkjet ejector and the average first ink drop position, to compute a distance between the computed distance between the identified first ink drop position for each inkjet ejector and the average first ink drop position and the last ink drop correction parameter for each inkjet ejector, and to store in the memory for each inkjet ejector the computed distance between the identified first ink drop position for an inkjet ejector and the average first ink drop position and the last ink drop correction parameter as the other ink drop correction parameter.

* * * * *